US006189378B1

(12) United States Patent
Kendrick et al.

(10) Patent No.: US 6,189,378 B1
(45) Date of Patent: Feb. 20, 2001

(54) ELECTRONICALLY CONTROLLED FUEL INJECTOR TRIMMING

(75) Inventors: Larry E. Kendrick, Peoria; Michael S. Lukich, Chillicothe; James H. Mutti, East Peoria, all of IL (US)

(73) Assignee: Caterpillar Inc., Peoria, IL (US)

( * ) Notice: Under 35 U.S.C. 154(b), the term of this patent shall be extended for 0 days.

(21) Appl. No.: 09/211,395

(22) Filed: Dec. 14, 1998

(51) Int. Cl.[7] ..... G01M 15/00
(52) U.S. Cl. ..... 73/119 A
(58) Field of Search ..... 123/357, 491, 123/680, 119 A

(56) References Cited

U.S. PATENT DOCUMENTS

| | | | | |
|---|---|---|---|---|
| 4,499,876 | | 2/1985 | Yamamoto | 123/446 |
| 4,928,642 | | 5/1990 | Atkinson et al. | 123/180 R |
| 5,117,790 | | 6/1992 | Clarke et al. | 123/321 |
| 5,131,371 | | 7/1992 | Wahl et al. . | |
| 5,357,912 | | 10/1994 | Barnes et al. | 123/357 |
| 5,445,128 | | 8/1995 | Letang et al. | 123/436 |
| 5,445,129 | | 8/1995 | Barnes | 123/446 |
| 5,709,192 | | 1/1998 | Zimmermann . | |
| 5,720,265 | * | 2/1998 | Maki et al. | 123/680 |
| 5,722,373 | * | 3/1998 | Paul et al. | 123/357 |
| 5,758,308 | * | 5/1998 | Maki et al. | 123/491 |

FOREIGN PATENT DOCUMENTS

| | | |
|---|---|---|
| 0 467 544 A2 | 1/1992 | (EP) . |
| 0 488 362 A2 | 3/1992 | (EP) . |
| WO 95/31638 | 11/1995 | (WO) . |

OTHER PUBLICATIONS

Research Disclosure, Apr., 1991, Two–Stroke Engine Control, 32448.

* cited by examiner

*Primary Examiner*—Benjamin R. Fuller
*Assistant Examiner*—Maurice Stevens
(74) *Attorney, Agent, or Firm*—W. Bryan McPherson

(57) ABSTRACT

The present invention provides a method and apparatus for determining a performance characteristic of at least one of a plurality of fuel injectors located within a fuel system. The method includes the steps of determining a first desired fuel quantity to be delivered by the plurality of injectors, suspending fuel delivery by one of the injectors, determining a second desired fuel quantity to be delivered by the injectors in response to the suspension, and determining a performance characteristic of the suspended injector in response to said first and the second desired fuel quantity.

14 Claims, 3 Drawing Sheets

ELECTRONICALLY CONTROLLED FUEL INJECTOR TRIMMING

DESCRIPTION

1. Technical Field

The present invention relates generally to a fuel control system for an engine, and more particularly, to a method and apparatus for determining a performance characteristic of a fuel injector located in a fuel system.

2. Background Art

The fuel quantity that is delivered to an engine may be determined by a fuel control governor. The governor determines the amount of fuel that should be injected by each fuel injector into the engine in order to achieve a desired engine speed. The governor then sends a fuel command to the fuel injectors to deliver the fuel. However, due to variances between each fuel injector, the same fuel command does not inherently result in the same quantity of fuel being delivered to the engine by each injector. The result of fuel variations may include engine speed variability, the production of white smoke from the engine, and a rough ride for the vehicle which the engine is located.

The present invention is directed to overcoming one or more of the problems set forth above.

DISCLOSURE OF THE INVENTION

In one aspect of the present invention, a method for determining a performance characteristic of at least one of a plurality of fuel injectors is disclosed. The method includes the steps of determining a first desired fuel quantity to be delivered by the injectors, suspending fuel delivery by one of the injectors and determining a performance characteristic of the suspended injector.

In yet another aspect of the present invention, a method for determining a performance characteristic of at least one of a plurality of fuel injectors is disclosed. The method includes the steps of determining a first fuel command to be delivered to the injectors, suspending fuel delivery by one of the injectors, and determining a performance characteristic of the suspended injector.

In yet another aspect of the present invention, an apparatus for determining a performance characteristic of at least one of a plurality of fuel injectors is disclosed. The apparatus includes a temperature sensing device adapted to sense a temperature of the engine and responsively generate a temperature signal; and a controller adapted to receive said temperature signal, determine a first desired fuel quantity to be delivered by each of the injectors, suspend fuel delivery by one of the injectors, and determine a performance characteristic of said suspended.

BEST MODE FOR CARRYING OUT THE INVENTION

Figure 1:
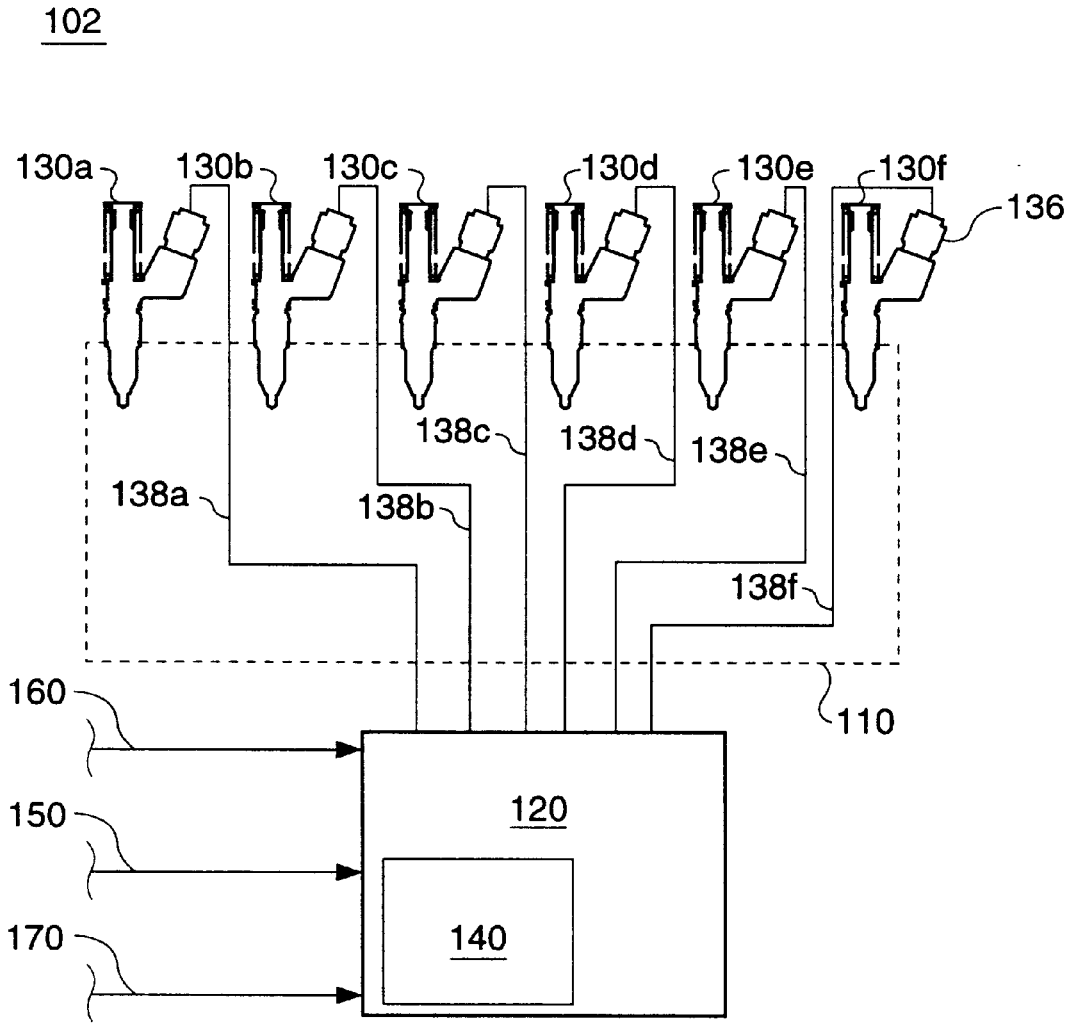
FIG. 1 is a high level diagram of one embodiment of an fuel system.

The present invention provides a method and apparatus for determining a performance characteristic of at least one of a plurality of fuel injectors located within a fuel system. FIG. 1 illustrates one embodiment of a fuel system 102 of an engine. The fuel system 102 includes a compression ignition engine 110, an electronic controller 120, and a plurality of electronic unit injectors 130*a–f*, one for each combustion chamber or cylinder (not shown). In one embodiment, the fuel system 102 may include a temperature sensor (not shown). The temperature sensor senses the temperature of the engine coolant and responsively generates a coolant temperature signal 150. The fuel system 102 may also include an engine speed sensor (not shown). In one embodiment, the engine speed sensor senses the signature of a timing wheel applied to the engine camshaft to indicate the engine's rotational position and speed. The engine speed sensor senses the engine speed and responsively generates a speed signal 160. The fuel system 102 may include a desired speed sensor (not shown). The desired speed sensor determines the desired speed of the engine 110 and generates a desired speed signal 170. In the preferred embodiment, the desired speed sensor senses the position of an operator controlled throttle. In an alternative embodiment, the desired speed sensor may receive the desired speed from a cruise control system (not shown).

The actual speed, desired speed, and temperature sensors are not shown in FIG. 1. However, the use of such sensors in connection with an engine is well known in the art. One skilled in the art could easily and readily implement such sensors in connection with an engine using the present invention.

The fuel system 102 includes an electronic controller 120. The electronic controller 120 is in electrical communication with each of the electronic unit injectors 130*a–f*. A memory 140 is included in the controller 120. The controller 120 receives the temperature signal 150, and the desired and actual speed signals 170, 160. The controller 120 includes a fuel control governor. The functions of the fuel control governor include controlling the timing and quantity of fuel delivered by the injectors 130*a–f* to the engine 110. The governor is able to independently control each of the fuel injectors 130*a–f*. In the preferred embodiment, the governor is a software program that executes on the electronic controller 120. The governor may utilize the memory 140 located on the controller 120.

Each of the electronic unit injectors 130*a–f* includes a solenoid 136 and is associated with a corresponding cylinder (not shown). Also, each of the electronic unit injectors 130*a–f* are individually connected to outputs of the electronic controller 120 by electrical connectors 138*a–f* respectively. As is known in the art, an injector signal from the electronic controller 120 independently activates the solenoid 136 on each electronic unit injector 130*a–f*. When the solenoid 136 is activated, fuel is injected into the corresponding cylinder.

Although, the preferred embodiment is discussed with respect to a six cylinder compression ignition engine, one skilled in the art could readily implement the present invention in connection with a compression ignition engine that utilizes a different number of cylinders, such as eight cylinders or sixteen cylinders.

The present invention provides a method and apparatus for determining a performance characteristic of at least one of a plurality of fuel injectors 130*a–f* located within a fuel system 102. The method includes the steps of determining a first desired fuel quantity to be delivered by each of the injectors 130*a–f*, suspending fuel delivery by one of the injectors, determining a second desired fuel quantity to be delivered by each of the injectors in response to suspending one of the injectors, and determining a performance characteristic of the suspended injector in response to the first and second desired fuel quantities.

Figure 2:
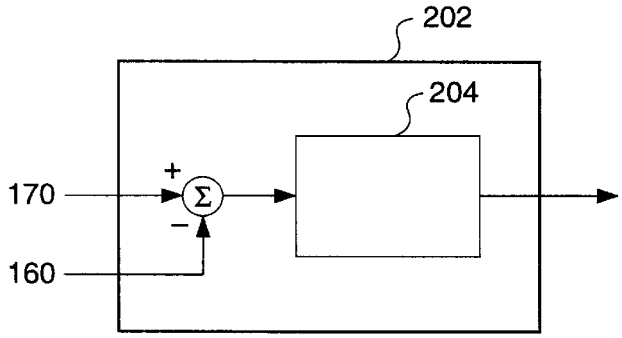
FIG. 2 is an illustration of a software block diagram of the fuel control governor.

During normal operation of a fuel system 102, the actual engine speed is sensed by a speed sensor, and an actual speed signal 160 may be delivered to the controller 120. In addition, a desired engine speed may be determined, and a desired speed signal 170 may be delivered to the controller 120. The fuel control governor, executing on the controller 120, receives the actual and desired speed signal and responsively determines a fuel command to be delivered to each of the fuel injectors 130*a–f*. FIG. 2 illustrates a software block diagram of the fuel control governor 202. In the preferred embodiment, the governor 202 compares the actual and desired speed signal and determines a speed error. The governor 202 utilizes a PID (proportional, integral, derivative) control algorithm 204 to determine a fuel command based on the speed error. The output of the algorithm may be in the form of a fuel command which is delivered to the solenoid 136 of the fuel injector 130 in order to control the amount of fuel delivered by the injector. That is, the fuel command is indicative of the desired fuel quantity to be delivered by the injector. For example, the duration of time the solenoid 136 of an injector 130 is energized by the fuel command, is proportional to the amount of fuel delivered by the injector 130. The desired fuel quantity is the fuel quantity, as determined by the governor 302, needed to be delivered by the injectors 130*a–f* in order for the engine to achieve the desired engine speed. An example of a classical forward path (discrete) PID control algorithm is shown below.

$$c_i = K_p e_i + K_I \sum_{j=0}^{i} e_j + K_D(e_i - e_{i-1})$$

Where:

$e_i$=error (desired speed−actual speed)

$C_i$=Command (Fuel) at time $t_i$ $K_P$=Proportional gain of the governor $K_I$=Integral gain of the governor $K_D$=Derivative gain of the governor The fuel command $C_i$ is then delivered to each fuel injector 130*a–j*. However, due to variations in manufacturing, or age of an injector 130*a–f*, the fuel delivery of each injector 130*a–f* resulting from identical fuel commands, may be different. One of the advantages of the present invention includes offsetting the effects of manufacturing variations.

Figure 3:
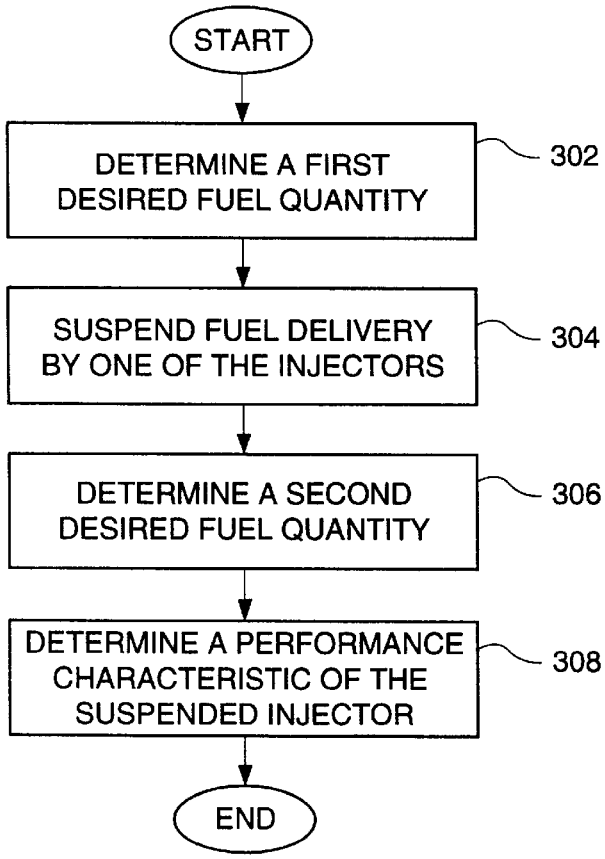
FIG. 3 is an illustration of the method for determining a performance characteristic of the suspended injector.

FIG. 3 illustrates a flow diagram of the method of the present invention. In a first control block 302, a first desired fuel quantity is determined. In the preferred embodiment, the first desired fuel quantity is the average of the desired fuel quantities to be delivered by each of the injectors, as determined by the governor 202. That is, the fuel command $C_i$ is indicative of the desired fuel quantity to be delivered by an injector.

In a second control block 304 fuel delivery by one of the injectors 130*a–f* is suspended, or cut out. The injection of fuel by an injector 130 may be suspended by not sending a command signal to, i.e., not energizing, the solenoid 136 of the injector 130. Therefore, the suspended injector 130 does not inject fuel into the cylinder. Suspending the fuel injection of an injector may also be referred to as cutting the injector out. The cylinder associated with the suspended injector will essentially provide no power to the engine. The suspended injector 130 can be any of the six injectors 130*a–f*. For example, the governor 302 may determine to cut out, i.e., suspend, injector 130*a*. Once the injector 130*a* is cut out, the other injectors 130*b–f* will continue to receive fuel commands and inject fuel into the engine 110. However, in the preferred embodiment, the desired speed and load of the engine 110 have not changed from before the injector 130, was cutout, i.e., the desired speed and load remain constant. Therefore five cylinders, for example, now need to provide the same power to the engine as the six cylinders previously provided. The PID control algorithm 204, by sensing the desired and actual speed, will compensate for the suspension of the injector 130. The actual engine speed will initially drop due to the disturbance of cutting out one of the injectors 130. This will increase the engine speed error ($e_i$) and, in one embodiment, the integral term of the governor 202 will increase until the actual engine speed reaches the desired engine speed. The result is an increase in the desired fuel quantity provided to the remaining five injectors 130. That is, the PID control algorithm 204 may detect a larger speed error, and increase the desired fuel quantity to be delivered by the remaining five injectors.

In a third control block 306, a second desired fuel quantity is determined once the injector 130 has been suspended. In the preferred embodiment, the second desired fuel quantity is the average desired fuel quantity determined by the PID controller 304 and delivered, via the fuel command, to the active injectors. The average desired fuel quantity may change to compensate for the suspension of the injector 130.

Figure 4A:
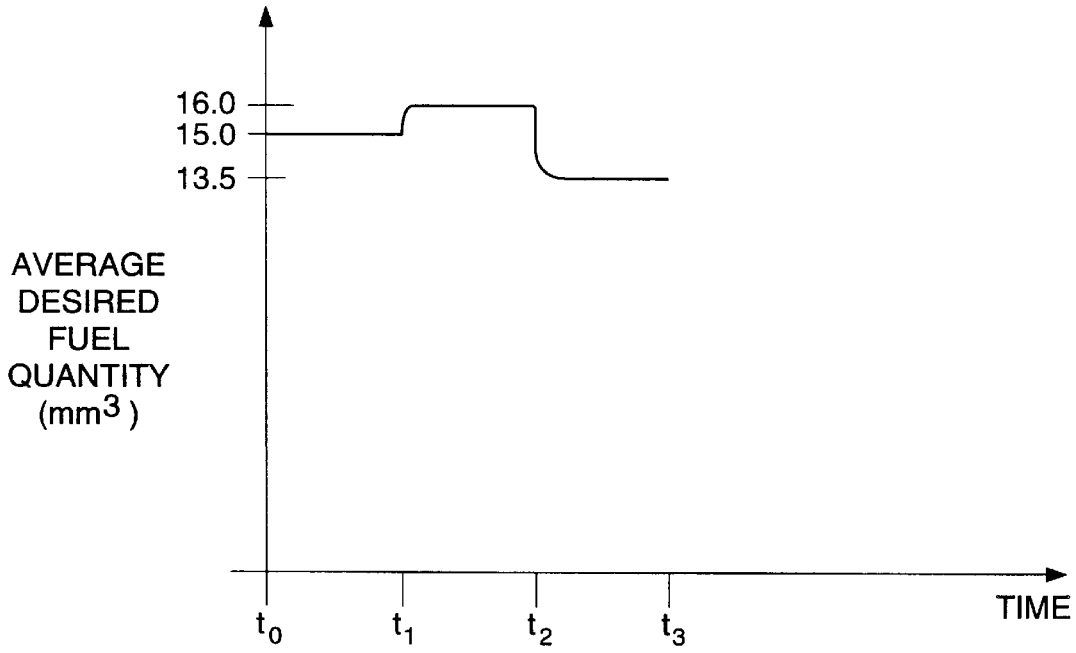
FIG. 4 is an illustration of an example of the calibration of an injector.
Figure 4B:
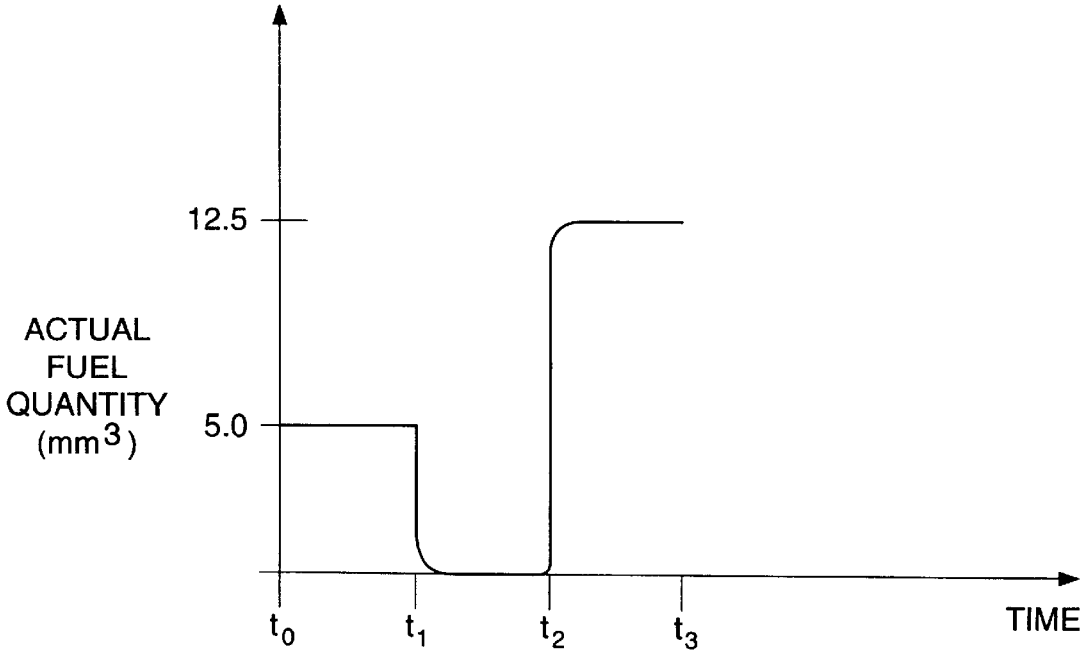

In a fourth control block 308, a performance characteristic of the fuel injector 130 may be determined in response to the first and second desired fuel quantity. In one embodiment, the performance characteristic may be the fuel quantity delivered by the suspended injector, prior to suspension. FIG. 4A illustrates a graph of the average, of the desired fuel quantity for each injector, as a function of time for the active injectors 130. FIG. 4B illustrates a graph of desired fuel quantity as a function of time for the injector 130 to be suspended. FIGS. 4A and 4B are for illustration purposes only and should not be interpreted to limit the scope of the present invention. The fuel quantities described in the following examples are also for illustration purposes only.

In the illustrations of FIGS. 4A and 4B, six fuel injectors 130*a–f* are active during the time period t0 to t1, and therefore are receiving fuel commands from the controller 120. At time t1 fuel delivery by one injector 130 is suspended. That is, the solenoid 136 associated with the suspended injector (injector 130*a* for example) is not energized via a fuel command and therefore the suspended injector 130 delivers no fuel. A second desired fuel quantity may be determined by averaging the desired fuel quantities of the five remaining active injectors 130*b–f*. As FIG. 4A illustrates, the average desired fuel quantity of the active injectors may increase. An increase may occur as the five active injectors 130*b–f* attempt to provide the same power to the engine that the six injectors 130*a–f* had been providing. That is, at time t1 when the injector 130*a* is suspended, the actual engine speed may drop resulting in an increased error between the desired and actual engine speed. To compensate for the increased error, the PID control algorithm 204 may increase the desired fuel quantity to be delivered by the remaining active injectors 130*b–f*.

The quantity of fuel being delivered by the suspended injector 130, prior to time t1 when it was suspended may be determined. The fuel quantity delivered may be determined in response to comparing the first and second desired fuel quantity. In the preferred embodiment, the second desired quantity may be subtracted from the first to determine a desired fuel quantity difference. The quantity difference may then be multiplied by the number of remaining active injectors. The resulting number indicates the quantity of fuel that was being delivered by the suspended injector, prior to suspension. For example, as illustrated in FIG. 4, if the first desired quantity is 15 $mm^3$ and the second desired quantity is 16 $mm^3$, then the fuel quantity being delivered by the suspended injector, prior to suspension, was (16 $mm^3$–15 $mm^3$)*5(active injectors)=5 $mm^3$. The fuel quantity being delivered by each of the injectors 130*a–f* may be determined through the use of the present invention, performing the analysis for each of the injectors.

In an alternative embodiment, the performance characteristic to be determined may be a fuel offset that may be used to modify the fuel command of the suspended injector, so that the injector is delivering the same amount of fuel, within a tolerance, as the active injectors. For example, as illustrated in FIG. 4A, an average desired fuel quantity of 16 $mm^3$ is delivered by the active injectors 130*b–f* during time t1 to t2. Prior to time t1, the suspended injector 130*a* was delivering 5 $mm^3$ of fuel, as described above. Therefore, the governor 202 may determine a fuel offset to be added to the desired fuel quantity of the suspended injector 130*a* such that the injector may deliver the same amount of fuel as the average desired fuel quantity. In one embodiment, the fuel offset may be a numerical offset added to the desired fuel quantity of the suspended injector when it is reactivated (or unsuspended). FIGS. 4A and 4B illustrate an example where a fuel offset is used to modify the desired fuel quantity of an injector. For example, the fuel offset is determined during time t1 to t2. At time t2 the suspended injector 130*a* is reactivated utilizing the fuel offset. The average desired fuel quantity may go down at time t2 because the reactivated injector 130*a* is providing more power to the engine than it was prior to time t1, therefore the other injectors do not need to provide as much power and the associated average desired fuel quantity may be reduced. In the event the fuel offset does not raise the fuel quantity delivered by the suspended fuel injector to the average, the method may be repeated. However, the reactivated fuel injector does not need to be suspended, or cut out, again because the average desired fuel quantity of the active injectors, without the injector under analysis 130*a*, has already been determined, as illustrated between time t1 and t2. Therefore, the average desired fuel quantity with the injector under analysis 130*a* being suspended (time t1 to t2), may be compared with the average desired fuel quantity with the injector reactivated (time t2 to t3). In the example illustrated in FIG. 4, the comparison indicates an increased fuel delivery by the reactivated injector 130*a*: (16 $mm^3$–13.5 $mm^3$)*5 injectors=12.5 $mm^3$. That is, after a fuel offset was determined and incorporated into the desired fuel quantity determination, the fuel quantity delivered by the reactivated injector rose to 12.5 $mm^3$. If the fuel quantity delivered is determined to be acceptable, then the analysis for that injector may stop. For example, if the fuel quantity delivered is within an error threshold, e.g., 1 $mm^3$, of the average desired fuel quantity then the injector performance may be determined to be acceptable. If, however, the desired fuel quantity is more than the error threshold away from the average, then the process may be repeated. Therefore, the fuel offset may again be modified and used to determine a desired fuel quantity to be delivered by the injector. Once the fuel injector under analysis has been calibrated, i.e., is delivering a fuel quantity within an acceptable tolerance of the average desired fuel quantity, another injector may be selected and the process repeated for that injector. The process may be used to calibrate each of the injectors 130*a–f* of the engine.

In an alternative embodiment, each injector may be suspended and reactivated one at a time, and a first fuel offset may be determined for each injector. However, a fuel offset for each injector is determined before any of the offsets are applied. Then, each fuel offset may be added to the desired fuel quantity for the appropriate injector, at once. Therefore each injector is essentially calibrated at the same time, instead of cycling through and calibrating one at a time.

In yet another embodiment, the performance characteristic to be determined may be whether the suspended injector is operational. In one embodiment, an injector may be determined to be either operational or functionally degraded. The fuel quantity delivered by the injector 130 may be compared with an operational threshold, e.g., 5 $mm^3$. For example, if the fuel quantity delivered by an injector 130, is between 0–5 $mm^3$, which is below the example operational threshold of 5 $mm^3$, then the injector may be determined to be functionally degraded. Alternatively, the delivered fuel quantity may be compared with the average desired fuel quantity, e.g., 15 $mm^3$. If the delivered fuel quantity of the injector under analysis is not within an operational threshold, e.g., 30%, of the average desired fuel quantity, then the injector may be determined to be functionally degraded. In the preferred embodiment, the governor 202 will attempt to add a fuel offset to the fuel command of the injector under analysis, to modify the fuel delivered by the injector. If the governor 302 is unable to determine a fuel offset, after multiple iterations if necessary, that will modify the fuel delivered to within an operational value, e.g., above 5 $mm^3$ or within 30% of the average desired value, then the injector may be determined to be functionally degraded, and the operator, either onboard or offboard, may be notified.

In the preferred embodiment of the present invention, the method is not performed until the engine is warmed up. For example, the temperature of the engine coolant, or oil may be sensed. If the temperature of the sensed fluid is above a predetermined value the engine may be determined to be warmed up and the analysis may be performed.

In addition, in the preferred embodiment, the analysis of the present invention is performed while the engine is under a constant desired speed and constant load. An estimate of the desired fuel quantity can be used to determine if the load changes. For example, a significant increase in desired fuel quantity may indicate a significant increase in load. If the change in the desired fuel quantity since the beginning of the analysis exceeds a threshold, then the load may be determined to have changed, and the analysis may be terminated.

The present invention may be used each time the engine is started. However, in the preferred embodiment, the analysis of the present invention is only performed periodically since it is unlikely that the characteristics of the injectors drastically changes from one day to the next. Therefore, when the analysis is performed, the fuel offsets may be saved into the memory 140 and used until the analysis is again performed.

In an alternative embodiment of the present invention, the performance characteristics of the injectors 130*a–f* may vary based on engine speed, load, and temperature. Therefore, the fuel offset used to deliver a fuel quantity within the acceptable range of the average desired fuel quantity may vary based on engine speed, engine load, or temperature. To address speed, load and temperature variability, a fuel offset may be determined for different values, or ranges of speed, load and temperature. Therefore, during the operation of the engine, the appropriate fuel offset may be used based on the operating conditions of the engine that exist at that time. The range of fuel offset values may be stored in memory 140.

Industrial Applicability

The present invention provides a method and apparatus for determining a performance characteristic of at least one of a plurality of fuel injectors located within a fuel system. The method includes the steps of determining a first desired fuel quantity to be delivered by the plurality of injectors, suspending fuel delivery by one of the injectors, determining a second desired fuel quantity to be delivered by the injectors in response to the suspension, and determining a performance characteristic of the suspended injector in response to said first and the second desired fuel quantity.

In the preferred embodiment, the present invention is used once the engine has warmed up and is running at a constant speed and load. The invention may be performed once the engine has been assembled, during maintenance, on a periodic basis, or every time the engine is started. In the preferred embodiment, the analysis is performed on a periodic basis, to ensure the appropriate amount of fuel being delivered by each of the fuel injectors of the engine.

Other aspects, objects, and advantages of the present invention can be obtained from a study of the drawings, the disclosure, and the claims.

What is claimed is:

1. A method for determining a performance characteristic of at least one of a plurality of fuel injectors located within a fuel system, comprising the steps of:

determining a first desired fuel quantity to be delivered by said plurality of injectors;

suspending fuel delivery by one of said plurality of injectors;

determining a second desired fuel quantity to be delivered by said plurality of injectors in response to said suspension; and determining said performance characteristic of said suspended injector in response to said first and said second desired fuel quantity.

2. A method, as set forth in claim 1, wherein the step of determining first fuel quantity said first desired fuel quantity includes providing an average of a desired fuel quantity for each of said injectors.

3. A method, as set forth in claim 2, the step of determining said second desired fuel quantity wherein the step of determining said second desired fuel quantity includes ascertaining a quantity of fuel to be delivered by a plurality of unsuspended injectors.

4. A method, as set forth in claim 3, wherein said second desired fuel quantity includes an average of said desired fuel quantity for each of said unsuspended injectors.

5. A method, as set forth in claim 1, wherein the step of determining said performance characteristic further comprises the steps of:

comparing said first and said second desired fuel quantity; and determining a fuel offset to be applied to said suspended injector in response to said comparison.

6. A method, as set forth in claim 1, wherein the step of determining said performance characteristic further comprises the steps of:

comparing said first and said second desired fuel quantity; and determining a fuel quantity delivered by said suspended injector in response to said comparison.

7. A method, as set forth in claim 6, wherein the step of determining said performance characteristic further comprises the steps of determining a fuel offset to be applied to said suspended injector in response to said delivered fuel quantity of said suspended injector.

8. A method, as set forth in claim 7, further comprising the step of activating said suspended injector.

9. A method, as set forth in claim 1, wherein the step of determining said performance characteristic further comprises the steps of:

comparing said first and said second desired fuel quantity; and determining an operational performance of said suspended injector in response to said comparison.

10. A method, as set forth in claim 1, wherein the step of determining said operational performance further comprises the step of determining said injector is one of operational and degraded in response to said first and said second desired fuel quantity.

11. A method for determining a performance characteristic of at least one of a plurality of fuel injectors located within a fuel system, comprising the steps of:

determining a first fuel command to be delivered to said plurality of injectors;

suspending fuel delivery by one of said plurality of injectors;

determining a second fuel command to be delivered to said plurality of injectors in response to said suspension; and determining said performance characteristic of said suspended injector in response to said first and said second fuel commands.

12. A method, as set forth in claim 11, wherein the step of determining said first fuel command further comprises the step of determining a first desired fuel quantity to be delivered by said plurality of injectors.

13. A method, as set forth in claim 12, wherein the step of determining said second fuel command further comprises the step of determining a second desired fuel quantity to be delivered by said plurality of injectors in response to said suspension.

14. An apparatus for determining a performance characteristic of at least one of a plurality of fuel injectors located within a fuel system, comprising the steps of:

a temperature sensing device adapted to sense a temperature of the engine and responsively generate a temperature signal; and a controller adapted to receive said temperature signal, determine said engine is warmed-up in response to said temperate signal, determine a first desired fuel quantity to be delivered by each of said plurality of injectors, suspend fuel delivery by one of said plurality of injectors, determine a second desired fuel quantity to be delivered by each of said plurality of unsuspended injectors in response to said suspension, and determine said performance characteristic of said suspended injector in response to said first and said second desired fuel quantity.

* * * * *